US007712261B2

(12) United States Patent
Zeigler

(10) Patent No.: US 7,712,261 B2
(45) Date of Patent: May 11, 2010

(54) COLLAPSIBLE STRUCTURE WITH SELF-LOCKING MECHANISM AND METHOD OF ERECTING A COLLAPSIBLE STRUCTURE

(75) Inventor: Theodore R. Zeigler, Alexandria, VA (US)

(73) Assignee: World Shelters, Inc., Alexandria, VA (US)

( * ) Notice: Subject to any disclaimer, the term of this patent is extended or adjusted under 35 U.S.C. 154(b) by 1760 days.

(21) Appl. No.: 10/779,632

(22) Filed: Feb. 18, 2004

(65) Prior Publication Data

US 2005/0204680 A1 Sep. 22, 2005

(51) Int. Cl.
*E04B 1/34* (2006.01)

(52) U.S. Cl. ..... 52/79.5; 52/645; 52/646; 135/135; 135/128

(58) Field of Classification Search ..... 52/63, 52/79.5, 645, 646, 109; 135/97, 121, 131, 135/135, 145, 159, 147
See application file for complete search history.

(56) References Cited

U.S. PATENT DOCUMENTS 3,968,808 A 7/1976 Zeigler
4,026,313 A 5/1977 Zeigler
4,156,433 A * 5/1979 Beaulieu ..... 135/145
4,193,414 A * 3/1980 Trochman ..... 135/145
4,280,521 A 7/1981 Zeigler
4,290,244 A 9/1981 Zeigler
4,334,660 A 6/1982 Zeigler
4,437,275 A 3/1984 Zeigler
4,473,986 A 10/1984 Zeigler
4,512,097 A 4/1985 Zeigler
4,522,008 A 6/1985 Zeigler
4,561,618 A 12/1985 Zeigler
4,579,066 A 4/1986 Zeigler
4,637,180 A 1/1987 Zeigler
4,666,102 A 5/1987 Colbaugh et al.
4,689,932 A 9/1987 Zeigler
4,747,239 A 5/1988 Zeigler
4,761,929 A 8/1988 Zeigler
4,800,663 A 1/1989 Zeigler
4,838,003 A 6/1989 Zeigler
4,970,841 A 11/1990 Zeigler
RE33,710 E 10/1991 Zeigler
5,230,196 A 7/1993 Zeigler
5,274,980 A * 1/1994 Zeigler ..... 52/646
5,444,946 A 8/1995 Zeigler
5,651,228 A 7/1997 Zeigler
5,943,837 A * 8/1999 Esser et al. ..... 52/646
6,141,934 A 11/2000 Zeigler (Continued)

*Primary Examiner*—Richard E Chilcot, Jr.
*Assistant Examiner*—Anthony N Bartosik
(74) *Attorney, Agent, or Firm*—WRB-IP LLP

(57) ABSTRACT

A collapsible structure with a self-locking mechanism includes a first hub, at least two struts pivotable connected at a first ends thereof to the first hub and movable relative to each another between a folded position and an expanded position, and a tension member adapted to limit pivotable movement of at least two struts such that, when in the expanded position, the at least two struts define an angle of less than 180°. The structure further includes a locking hub and at least two locking struts pivotably connected at first ends thereof to the locking hub and, at seconds ends thereof, to connection points on respective ones of the at least two struts. A method of erecting a structure is also disclosed.

22 Claims, 5 Drawing Sheets

U.S. PATENT DOCUMENTS 6,196,242 B1 * 3/2001 Xu ..... 135/20.1
6,401,735 B1 * 6/2002 Chou ..... 135/20.1
6,941,704 B2 * 9/2005 Chen et al. ..... 52/79.5
2002/0066239 A1 * 6/2002 Gillis ..... 52/83
2003/0074845 A1 * 4/2003 Sample et al. ..... 52/63
2003/0164185 A1 * 9/2003 Price ..... 135/131

* cited by examiner

COLLAPSIBLE STRUCTURE WITH SELF-LOCKING MECHANISM AND METHOD OF ERECTING A COLLAPSIBLE STRUCTURE

BACKGROUND AND SUMMARY

The present invention relates to collapsible structures and, more particularly, to collapsible structures with self-locking mechanism and methods of erecting a collapsible structure.

My prior U.S. Pat. Nos. 6,141,934, 5,651,228, 5,444,946, 5,274,980, 5,230,196, RE33,710, 4,970,841, 4,838,003, 4,800,663, 4,761,929, 4,747,239, 4,689,932, 4,666,102, 4,637,180, 4,579,066, 4,561,618, 4,522,008, 4,512,097, 4,473,986, 4,437,275, 4,334,660, 4,290,244, 4,280,521, 4,026,313, and 3,968,808 are incorporated by reference and show various collapsible structures and components therefor. In many collapsible structures of the general type described in these patents, in the course of erecting the structures, the structures must extend beyond the dimensions of the erected shelter. For example, in my U.S. Pat. Nos. 5,444,946 and 5,274,980, in the course of erecting the shelters, they are typically expanded laterally outward significantly past the lateral dimensions of the finished structure. This makes it difficult to provide the structures with a cover as is typically provided on portable shelter type devices. Ordinarily, the covers are attached after erection of the frame of the structure.

Also, because the structures during erection are typically expanded beyond the footprint of the structures in their erected condition, they are generally only secured to the ground or a base after they are finally erected. This can make erection of the structures difficult. For example, in windy conditions, the structures may be blown around. This problem can be exacerbated if there is cover material on the frame because the cover material can act as a sail and make it that much more difficult to erect the structure.

During break down of these structures, the same problems occur as during erection. The covers are ordinarily taken off and the structures are ordinarily disconnected from any ground or base supporting structures before lowering the frame.

It is desirable to provide a collapsible structure that can be erected and broken down without the need to remove a cover from the structure. It is also desirable to provide a structure that can be secured to the ground or a base while the structure is being erected or broken down.

In accordance with one aspect of the present invention, a collapsible structure with a self-locking mechanism includes a first hub, at least two struts pivotably connected at first ends thereof to the first hub and movable relative to each another between a folded position and an expanded position, and a tension member adapted to limit pivotable movement of the at least two struts such that, when in the expanded position, the at least two struts define an angle of less than 180°. The structure further includes a locking hub and at least two locking struts pivotably connected at first ends thereof to the locking hub and, at seconds ends thereof, to connection points on respective ones of the at least two struts.

In accordance with another aspect of the present invention, a method of erecting a collapsible structure includes unfolding a collapsible structure from a folded condition to a collapsed condition. A plurality of base-defining ends of a plurality of end struts of the collapsible structure are fixed in the collapsed condition to points on a surface, the points generally defining a size of a base of the structure in the erected condition. After fixing the base-defining ends to the points on the surface, a center region of the collapsible structure is lifted to an erected height of the collapsible structure. The collapsible structure is locked in an erected condition after lifting the structure to its erected height using an internal locking arrangement of the collapsible structure.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1A:
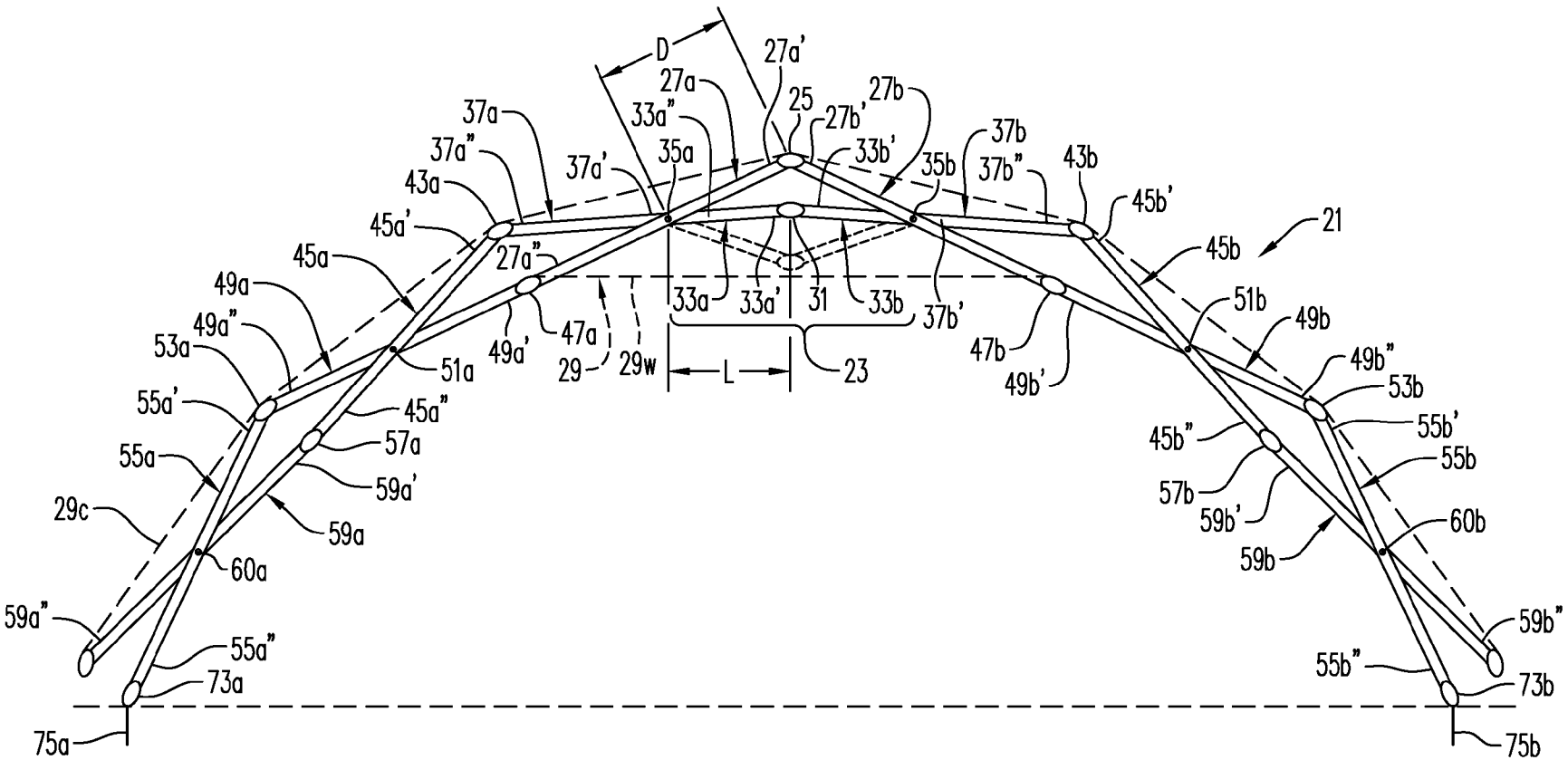
FIG. 1A is a side view of a collapsible structure according to an embodiment of the present invention in an erected condition.

A collapsible structure 21 according to the present invention is seen in FIG. 1A. The structure 21 includes what is referred to for purposes of the present application as a self-locking mechanism 23, seen in isolated in FIG. 1B, for locking the structure in an erected condition. The structure 21 has a self-locking mechanism 23 in the sense that the self-locking mechanism 23 can maintain the structure in an erected condition by itself, without the need for additional locking structures. However, additional locking structures may be used with the structure 21, such as to provide additional strength.

Figure 3:
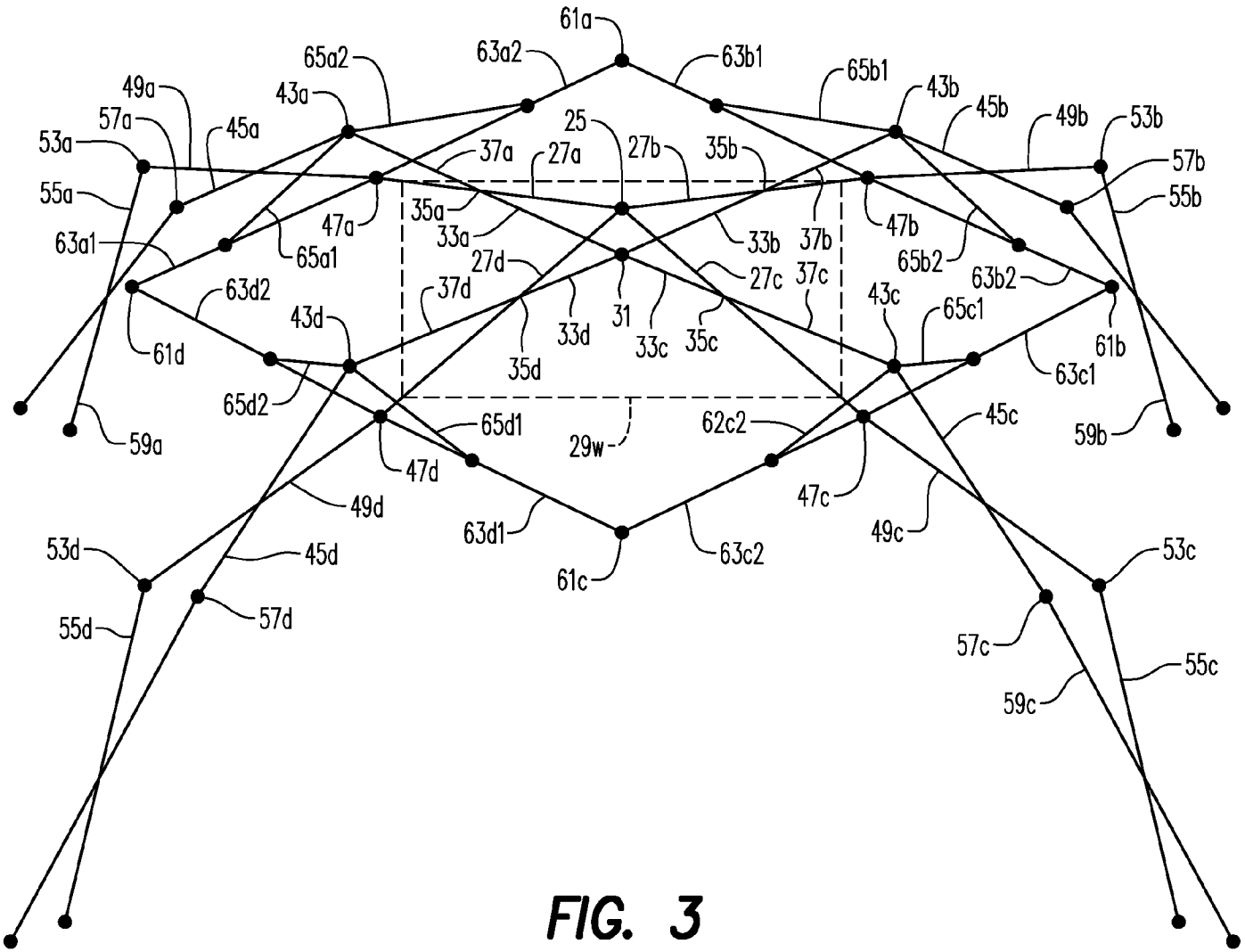
FIG. 3 is a perspective view of a collapsible structure according to an embodiment of the present invention.

The structure 21 includes a first hub 25 and at least two struts 27*a* and 27*b* pivotably connected at first ends 27*a*' and 27*b*' thereof to the first hub. The structure 21 includes at least two struts but will ordinarily include three or four struts (FIG. 3). Structures with more than four struts may also be provided, depending upon, for example, the shape of the structure desired. The struts 27*a* and 27*b* are preferably light weight rods, such as aluminum tubes. The hubs 25 may take a variety of suitable forms such as, for example, the form of the hubs described in U.S. Pat. No. 4,280,521, which is incorporated by reference, and permit pivotal attachment of the struts.

The struts 27*a* and 27*b* are movable relative to each another between a folded position (FIG. 2) and an expanded position (FIG. 1A). The structure 21 also includes a tension member 29 adapted to limit pivotable movement of the struts 27*a* and 27*b* such that, when in the expanded position, the struts define an angle of less than 180° when viewed from the side, i.e., they are not coplanar. Of course, when viewed from the top, two struts 27*a* and 27*b* may be arranged at 180° relative to one another.

The tension member 29 may take a number of different forms. The tension member 29 may, for example, be a wire 29*w* that is attached to the struts 27*a* and 27*b*, a cover 29*c* of the collapsible structure 21, such as a fabric cover, or a base 29*b* to which the collapsible structure is attached. Ordinarily, multiple different tension members will be used simultaneously.

The self-locking mechanism 23 also includes a locking hub 31 and at least two locking struts 33*a* and 33*b* pivotably connected at first ends 33*a*' and 33*b*' thereof to the locking hub. The locking struts 33*a* and 33*b* are connected at seconds ends 33*a*" and 33*b*" thereof to connection points 35*a* and 35*b* on respective ones of the at least two struts 27*a* and 27*b*. The locking hub 31 is structured to limit the angle through which struts attached to the locking hub can pivot. More particularly, the locking hub 31 permits the struts to pivot through an angle greater than 180° when the struts are viewed from the side. Stated differently, the locking hub 31 permits the struts to move from a first position, such as a folded position in which the struts are all substantially parallel to one another, to a locked position that is reached after the struts pass through a position in which they lie in the same plane, i.e., are at an angle of 180° to one another when viewed from the side.

Figure 1B:
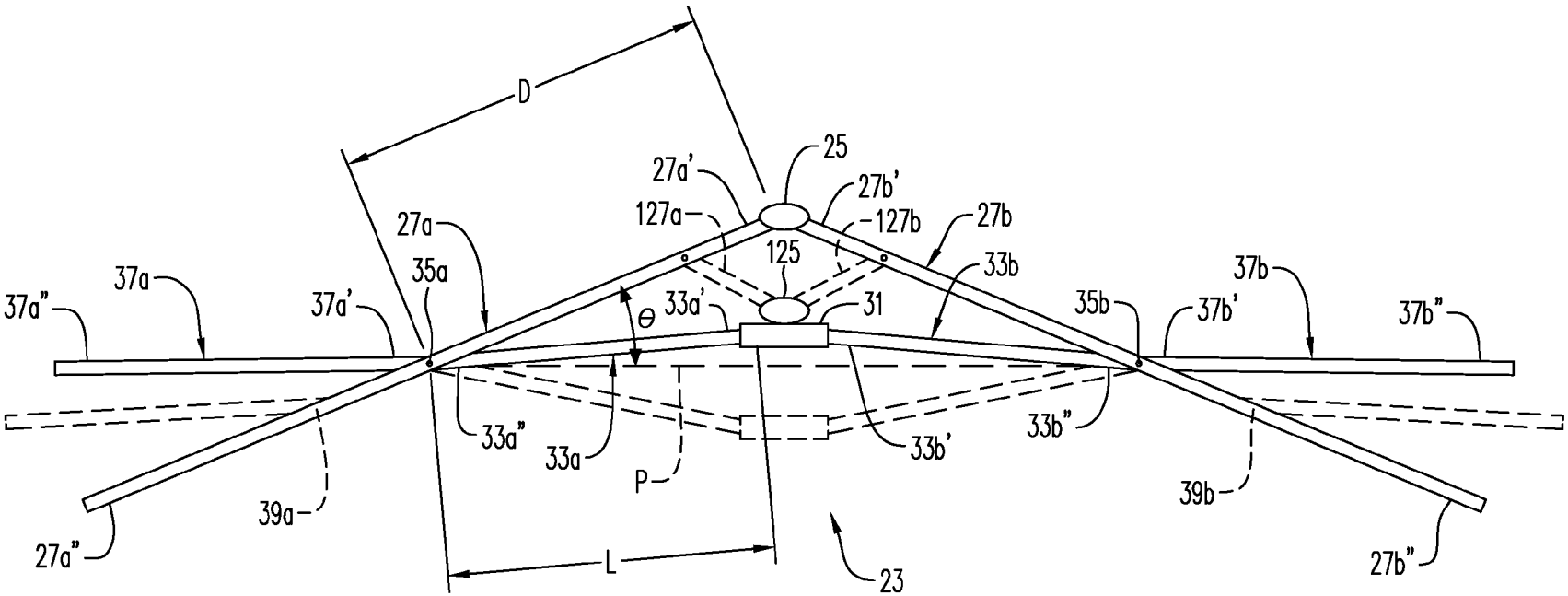
FIG. 1B is a side view of a portion of the structure of FIG. 1A.

As seen in FIG. 1B, a distance D between a connection point 35*a* or 35*b* and the first hub 25 for any one the struts 27*a* and 27*b* is greater than a length L of a respective one of the locking struts 33*a* or 33*b*. However, the distance between the connection point 35*a* or 35*b* and the first hub 25 for the one of the at least two struts 27*a* or 27*b* multiplied by a cosine of an angle Θ defined by a plane P in which the connection points and of all of the struts lie and one of the struts 27*a* or 27*b* is less than the length L of the respective one of the at least two locking struts 33*a* or 33*b*.

When erecting the structure 21, the structure is locked in place with the self locking mechanism 23 by causing the locking struts 33*a* and 33*b* to pivot through an angle greater than 90° relative to the locking hub when the locking struts are moved between a folded position (FIG. 2) and a locked position (FIGS. 1A and 1B). In other words, the locking struts 33*a* and 33*b* pass through the plane defined by the connection points 35*a* and 35*b*, even though the combined length of the locking struts is greater than the distance between the connection points. This is ordinarily permitted to occur due to the flexibility of the components of the structure 21 such as the struts 27*a* and 27*b*, the locking struts 33*a* and 33*b*, and the tension member 29.

In order to cause the locking struts 33*a* and 33*b* to pass through the plane P, a user erecting the structure applies a force, which will ordinarily be applied upwardly to the locking hub 31, sufficient to overcome the force with which the tension member 29 resists moving the locking struts through the plane by resisting movement of the struts 27*a* and 27*b* past the predetermined degree of maximum separation. Once the locking struts 33*a* and 33*b* have passed upwardly through the plane P, the locking struts will only move downwardly through the plane by applying a downwardly directed force and, as a result, the structure 21 will remain in an erected condition. If desired, an additional locking mechanism can be provided to assist the locking struts 33*a* and 33*b* to keep the structure 21 in an erected condition. Also, as seen in FIG. 1B, it is desirable to provide a stop to prevent the locking hub 31 from extending too far upwardly and to provide support for the locking hub. The stop may take a variety of suitable forms. A stop in the form of a hub 125 pivotably attached to first and second struts 127*a* and 127*b* that are, in turn, pivotably attached to struts 27*a* and 27*b*, respectively, is shown.

Figure 2:
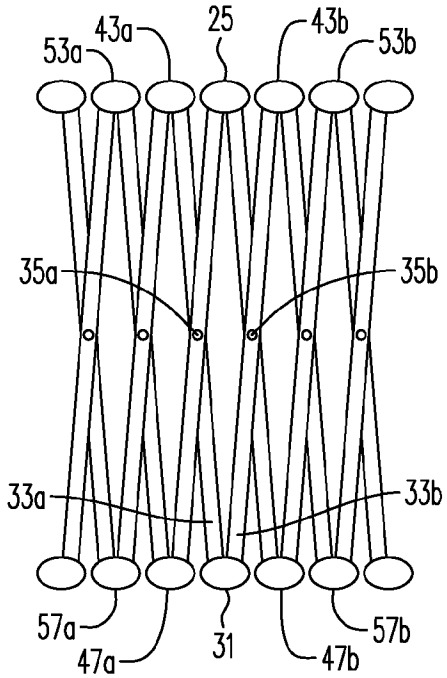
FIG. 2 is a side view of a collapsible structure according to an embodiment of the present invention in a folded condition.

As seen in FIGS. 1A and 1B, the collapsible structure 21 preferably also includes at least two second struts 37*a* and 37*b* pivotably connected at first ends thereof 37*a*' and 37*b*' to respective ones of the at least two struts 27*a* and 27*b*. The at least two second struts 37*a* and 37*b* can be pivotably connected to the at least two struts 27*a* and 27*b* at the connection points 35*a* and 35*b* on respective ones of the at least two struts or, as seen in FIG. 1B in phantom, at points 39*a* and 39*b* between the connection points and the second ends 27*a*" and 27*b*" of respective ones of the at least two struts 27*a* and 27*b*. The lengths of the various struts and the position of pivot or connection points of the various struts will ordinarily be selected such that, when the structure 21 is in a folded condition, all of the struts will be substantially parallel to one another, as seen in FIG. 2.

As seen in FIG. 1A, the structure 21 includes at least two second hubs 43*a* and 43*b*. Second ends 37*a*" and 37*b*" of the at least two second struts 37*a* and 37*b* are pivotably connected to respective ones of the at least two second hubs 43*a* and 43*b*.

The structure 21 further includes at least two third struts 45*a* and 45*b*. First ends 45*a*' and 45*b*' of the at least two third struts 45*a* and 45*b* are pivotably connected to respective ones of the at least two second hubs 43*a* and 43*b*.

The structure 21 further includes at least two third hubs 47*a* and 47*b*. Second ends 27*a*" and 27*b*" of the at least two first struts 27*a* and 27*b* are pivotably connected to respective ones of the at least two third hubs 47*a* and 47*b*.

The structure 21 further includes at least two fourth struts 49*a* and 49*b*. First ends 49*a*' and 49*b*' of the at least two fourth struts 49*a* and 49*b* are pivotably connected to respective ones of the at least two third hubs 47*a* and 47*b* and are pivotably connected at connection points 51*a* and 51*b* to respective ones of the at least two third struts 45*a* and 45*b*.

Similar to the pivoting of the locking struts 33*a* and 33*b* relative to the locking hub 31, the first struts 27*a* and 27*b* and the fourth struts 49*a* and 49*b* are each ordinarily adapted to pivot through an angle greater than 90° when the first struts and fourth struts pivot relative to respective ones of the third hubs 47*a* and 47*b* between a folded position and a locked position. The third hubs 47*a* and 47*b* are ordinarily arranged to permit the pairs of struts 27*a* and 49*a* and 27*b* and 49*b* to pivot through an angle greater than 180°, when the struts are viewed from the side. Stated differently, the third hubs 47*a* and 47*b* permit the struts 27*a* and 49*a* and 27*b* and 49*b* to move from a first position, such as a folded position in which the struts are all substantially parallel to one another, to a locked position that is reached after the struts pass through a position in which they lie in the same plane, i.e., are at an angle of 180° to one another when viewed from the side.

The collapsible structure 21 seen in FIG. 1A also includes at least two fourth hubs 53*a* and 53*b*. Second ends 49*a*" and 49*b*" of the at least two fourth struts 49*a* and 49*b* are pivotably connected to respective ones of the at least two fourth hubs 53*a* and 53*b*.

The collapsible structure 21 seen in FIG. 1A also includes at least two fifth struts 55*a* and 55*b*. First ends 55*a*' and 55*b*' of the at least two fifth struts 55*a* and 55*b* are pivotably connected to respective ones of the at least two fourth hubs 53*a* and 53*b*.

The collapsible structure 21 seen in FIG. 1A also includes at least two fifth hubs 57*a* and 57*b*. Second ends 45*a*" and 45*b*" of the at least two third struts 45*a* and 45*b* are pivotably connected to respective ones of the at least two fifth hubs 57*a* and 57*b*.

The collapsible structure 21 seen in FIG. 1A also includes at least two sixth struts 59*a* and 59*b*. First ends 59*a*' and 59*b*' of the at least two sixth struts 59*a* and 59*b* are pivotably connected to respective ones of the at least two fifth hubs 57*a* and 57*b*. The at least two sixth struts 59*a* and 59*b* are pivotably connected to respective ones of the at least two fifth struts 55*a* and 55*b* at connection points 60*a* and 60*b*.

Similar to the pivoting of the locking struts 33*a* and 33*b* relative to the locking hub 31, and the pivoting of the first struts 27*a* and 27*b* and the fourth struts 49*a* and 49*b* relative to the third hubs 47*a* and 47*b*, the third struts 45*a* and 45*b* and the sixth struts 59*a* and 59*b* are ordinarily each adapted to pivot through an angle greater than 90° when the third struts and sixth struts pivot relative to respective ones of the fifth hubs 57*a* and 57*b* between a folded position and a locked position. The fifth hubs 57*a* and 57*b* are ordinarily arranged to permit the pairs of struts 45*a* and 59*a* and 45*b* and 59*b* to pivot through an angle greater than 180°, when the struts are viewed from the side. Stated differently, the fifth hubs 57*a* and 57*b* permit the struts 45*a* and 59*a* and 45*b* and 59*b* to move from a first position, such as a folded position in which the struts are all substantially parallel to one another, to a locked position that is reached after the struts pass through a position in which they lie in the same plane, i.e., are at an angle of 180° to one another when viewed from the side.

A collapsible structure 21 having four strut and hub arrangements extending radially from a centerpoint is shown in FIG. 3. Here, the collapsible structure includes four struts 27*a*, 27*b*, 27*c*, and 27*d* pivotably connected at first ends thereof to the first hub 25. The struts 27*a*, 27*b*, 27*c*, and 27*d* are spaced relative to one another about the first hub 25 at 90° and are movable relative to each another between a folded position and an expanded position. A tension member such as a wire 29*w* attached to the first struts 27*a*, 27*b*, 27*c*, and 27*d* is provided that is adapted to limit pivotable movement of the struts such that, when in the expanded position, the four struts define an angle of less than 180°.

Four locking struts 33*a*, 33*b*, 33*c*, 33*d* are pivotably connected at first ends thereof to the locking hub 31. The locking struts 33*a*, 33*b*, 33*c*, 33*d* are connected at seconds ends thereof, to connection points 35*a*, 35*b*, 35*c*, 35*d* on respective ones of the four struts 27*a*, 27*b*, 27*c*, and 27*d*. Four second struts 37*a*, 37*b*, 37*c*, and 37*d* are pivotably connected at first ends thereof to respective ones of the four struts 27*a*, 27*b*, 27*c*, and 27*d*. Four second hubs 43*a*, 43*b*, 43*c*, 43*d* are provided. Second ends of the four second struts 37*a*, 37*b*, 37*c*, and 37*d* are pivotably connected to respective ones of the four second hubs. Four third hubs 47*a*, 47*b*, 47*c*, 47*d* are provided. Second ends of the four first struts 27*a*, 27*b*, 27*c*, and 27*d* are pivotably connected to respective ones of the four third hubs 47*a*, 47*b*, 47*c*, 47*d*.

The four strut and hub arrangements may be tied together by extension arrangements including four extension hubs 61*a*, 61*b*, 61*c*, 61*d*, eight extension struts, 63*a*1, 63*b*1, 63*c*1, 63*d*1, 63*a*2, 63*b*2, 63*c*2, 63*d*2, and eight extension arms 65*a*1, 65*b*1, 65*c*1, 65*d*1, 65*a*2, 65*b*2, 65*c*2, 65*d*2. Four pairs 63*a*1 and 63*a*2, 63*b*1 and 63*b*2, 63*c*1 and 63*c*2, and 63*d*1 and 63*d*2 of the eight extension struts are pivotably connected at first ends thereof to respective ones of the four second hubs 43*a*, 43*b*, 43*c*, 43*d* at right angles to the second struts 37*a*, 37*b*, 37*c*, 37*d* and are pivotably connected at second ends thereof to respective ones of the four extension hubs 61*a*, 61*b*, 61*c*, 61*d*. Four pairs 65*a*1 and 65*a*2, 65*b*1 and 65*b*2, 65*c*1 and 65*c*2, and 65*d*1 and 65*d*2 of the eight extension arms are pivotably connected at first ends thereof to respective ones of the four third hubs 47*a*, 47*b*, 47*c*, 47*d* at right angles to the first struts 27*a*, 27*b*, 27*c*, 27*d* and each of the eight extension arms are pivotably connected at second ends thereof to respective ones of the eight extension struts 63*a*1 and 63*a*2, 63*b*1 and 63*b*2, 63*c*1 and 63*c*2, and 63*d*1 and 63*d*2. In addition to tying together the four strut and hub arrangements, the extension arrangements can provide a collapsible structure 21 with sides that are more vertical, thus providing more usable space within the structure. Instead of or in addition to the extension arrangements described, however, additional strength and suitable side verticality can be obtained by providing a self-locking mechanism substantially like the mechanism 23 and having at least two scissors instead of the single scissor formed by the struts 55*a* and 59*a*, 55*b* and 59*b*, 55*c* and 59*c*, and 55*d* and 59*d*.

Figure 4A:
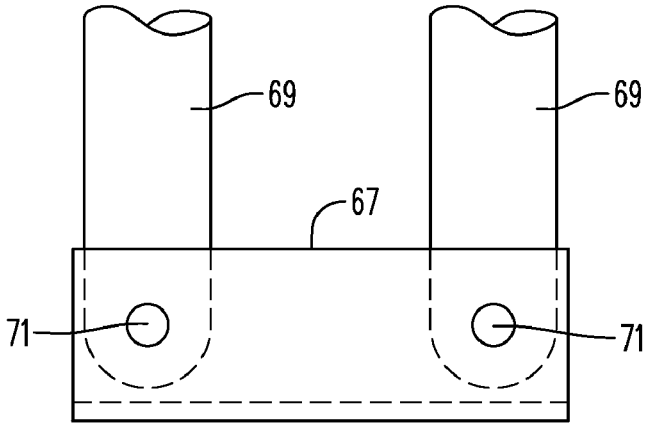
FIGS. 4A-4C are perspective views of a hub according to an embodiment of the present invention.
Figure 4B:
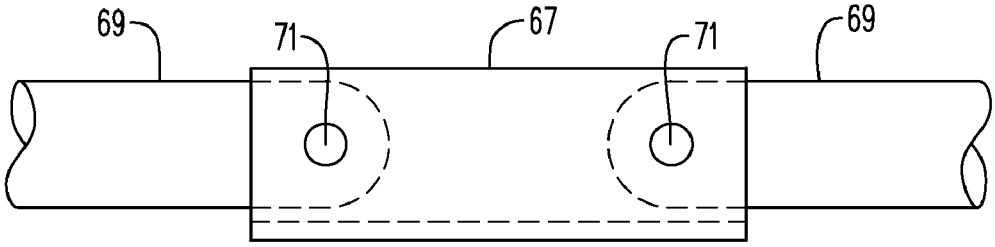
Figure 4C:
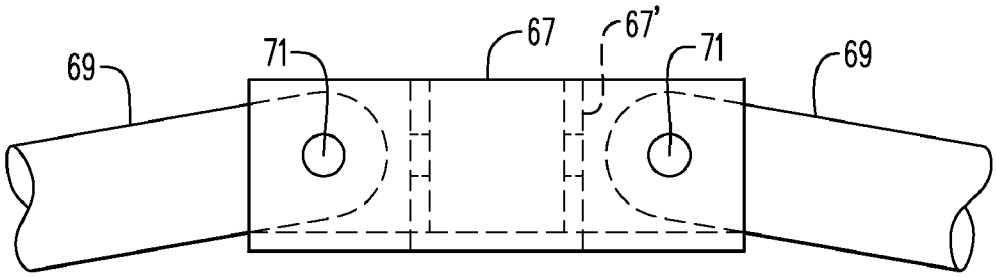

Turning to the embodiment shown in FIG. 1A, the locking hub 31, the third hubs 47*a*, 47*b*, and the fifth hubs 57*a*, 57*b* may be in the form of U-shaped channel structures 67 as shown in FIGS. 4A-4C. The type of hub shown in FIGS. 4A-4C limits the amount that the struts can pivot and is particularly well-suited for use as the locking hub 31, the third hubs 47*a*, 47*b*, and the fifth hubs 57*a*, 57*b*. The first hub 25, the second hubs 43*a*, 43*b*, and the fourth hubs 53*a*, 53*b* may also be of the form shown in FIGS. 4A-4C. Struts 69 are pivotably attached to the channel structure 67 by pivot pins 71. The struts 69 can be folded so that they are substantially parallel to one another as seen in FIG. 4A. The struts 69 can be unfolded past a position in which they are substantially coaxial and lie in a common plane, i.e., they are disposed at 180° to one another and have each pivoted 90° from their initial, folded position as seen in FIG. 4B. The struts 69 can be pivoted to a point where they are blocked from pivoting further by the channel structure 67, as shown in FIG. 4C. As shown in FIG. 4C in phantom, additional channels 67' can be attached to a main channel 67 to permit additional struts 69 to be attached. In the embodiment of the collapsible structure 21 shown in FIG. 3, the locking hub 31, the first hub 25, the second hubs 43*a*, 43*b*, 43*c*, 43*d*, and the third hubs 47*a*, 47*b*, 47*c*, and 47*d* can be arranged to have four struts attached to them.

Figure 5:
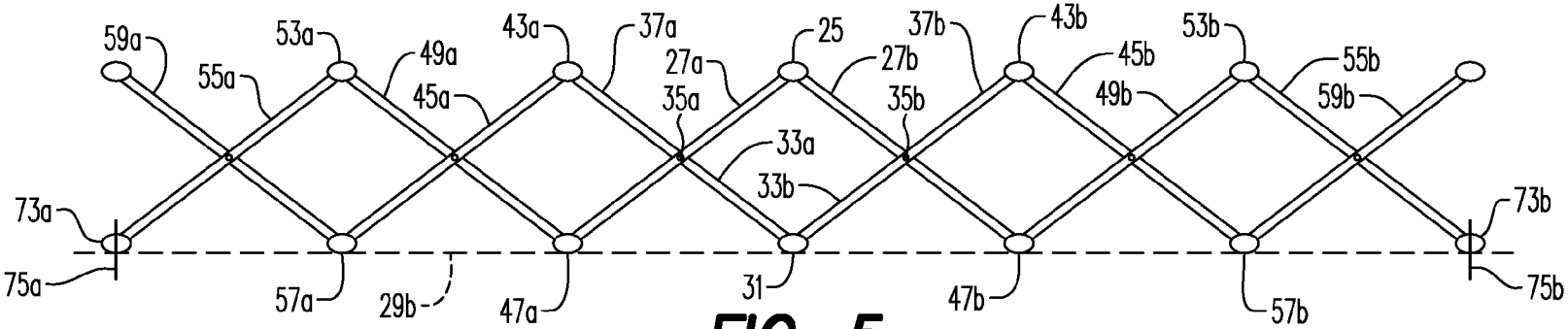
FIG. 5 is a side view of a collapsible structure according to an embodiment of the present invention, showing the structure in a position between a folded condition and an erected condition.

A method of erecting a collapsible structure 21 is seen in FIGS. 2, 5, and 1A. In the method, a collapsible structure 21 is unfolded from a folded condition as seen in FIG. 2 to a collapsed condition as seen in FIG. 5. While in the collapsed condition, a plurality of base-defining ends 73*a* and 73*b* of a plurality of end struts such as the fifth struts 55*a* and 55*b* or the sixth struts 59*a* and 59*b* or both are fixed to points 75*a* and 75*b* on a surface such as the ground or a base structure 29*b*. The points 75*a* and 75*b* generally define a size of a base of the structure 21 in the erected condition. After fixing the base-defining ends 73*a* and 73*b* to the points 75*a* and 75*b* on the surface, a center region of the collapsible structure 21 is lifted to an erected height as seen in FIG. 1A. The collapsible structure 21 is locked in an erected condition after lifting the structure to its erected height using an internal locking arrangement 23 of the collapsible structure.

The internal locking arrangement 23 includes the first hub 25. At least two struts 27*a* and 27*b* are pivotably connected at first ends 27*a*' and 27*b*' thereof to the first hub 25 movable relative to each another between a folded position (FIG. 2) and an expanded or erected position FIG. 1A. A tension member such as a wire, a cover, or a base limits pivotable movement of the at least two struts 27*a* and 27*b* such that, when in the erected position, the at least two struts define an angle of less than 180°. A locking hub 31 is provided. At least two locking struts 33*a* and 33*b* are pivotably connected at first ends 33*a*' and 33*b*' thereof to the locking hub 31 and, at seconds ends thereof, to connection points 35*a* and 35*b* on respective ones of the at least two struts 27*a* and 27*b*. Each of the locking struts 33*a* and 33*b* is pivoted relative to the locking hub 31 through an angle greater than 90° between a folded position of the locking struts when the collapsible structure is in the folded condition (FIG. 2) and a locked position of the locking struts (FIG. 1A) when the collapsible structure is in the erected condition.

The structure 21 shown in FIGS. 2, 5, and 1A is simple to erect particularly in view of the fact that the base-defining ends 69*a* and 69*b* of the structure can be fixed in place before erecting the structure. Also, the structure 21 can be provided with a cover that can remain on the structure at all times and need not be detached during erection or during break down. A user can then stand inside of the structure 21 and lift the locking hub 31 upwardly to lock the locking mechanism 23. The structure 21 need not be splayed across the ground prior to erection and can be set up in minimal space.

The structure 21 will remain in the erected condition shown in FIG. 1A until the locking arrangement 23 is moved to an unlocked position by pulling downwardly on the locking hub 31 and the locking struts 31 so that the locking struts again pass through a plane in which they are coplanar. When collapsing the structure 21, it can be collapsed by "imploding" it, without the need for expanding the structure outwardly beyond the confines of the outline of the base of the structure.

If desired, the structure 21 can be further supported in the erected condition by additional structures, such as structures designed to prevent unlocking of the locking arrangement 23 such as cords, chains, clips, and the like. As seen in FIG. 1, a cover 29*c* is ordinarily provided on the outside of the structure 21. If desired, a cover (not shown) can also be provided on the inside of the structure.

While this invention had been illustrated and described in accordance with a preferred embodiment, it is recognized that variations and changes may be made therein without departing from the invention as set forth in the claims.

What is claimed is:

1. A collapsible structure with a self-locking mechanism, comprising:

a first hub;

at least two struts pivotably connected at first ends thereof to the first hub and movable relative to each another between a folded position and an expanded position;

a tension member adapted to limit pivotable movement of the at least two struts such that, when in the expanded position, the at least two struts define an angle of less than 180°;

a locking hub having no rigid connection to the first hub;

at least two locking struts pivotably connected at first distal ends thereof to the locking hub and, at second distal ends thereof, to connection points on respective ones of the at least two struts; and second struts pivotably connected at first ends thereof to respective ones of the at least two struts, wherein the tension member includes a cover attached to the collapsible structure at second ends of the second struts.

2. The collapsible structure as set forth in claim 1, wherein the tension member comprises a base attached to the collapsible structure.

3. A collapsible structure with a self-locking mechanism, comprising:

a first hub;

at least two struts pivotably connected at first ends thereof to the first hub and movable relative to each another between a folded position and an expanded position;

a tension member adapted to limit pivotable movement of the at least two struts such that, when in the expanded position, the at least two struts define an angle of less than 180°;

a locking hub having no rigid connection to the first hub; and at least two locking struts pivotably connected at first distal ends thereof to the locking hub and, at second distal ends thereof, to connection points on respective ones of the at least two struts, wherein the tension member includes a surface upon which bottom ends of the at least two struts of the collapsible structure are disposed when the collapsible structure is erected.

4. A collapsible structure with a self-locking mechanism, comprising:

a first hub;

at least two struts pivotably connected at first ends thereof to the first hub and movable relative to each another between a folded position and an expanded position;

a tension member adapted to limit pivotable movement of the at least two struts such that, when in the expanded position, the at least two struts define an angle of less than 180°;

a locking hub having no rigid connection to the first hub; and at least two locking struts pivotably connected at first distal ends thereof to the locking hub and, at second distal ends thereof, to connection points on respective ones of the at least two struts, wherein the locking struts are each adapted to pivot through an angle greater than 90° relative to the locking hub when the locking struts are moved between a folded position and a locked position.

5. The collapsible structure as set forth in claim 4, wherein the tension member includes a wire.

6. The collapsible structure as set forth in claim 4, wherein the wire is attached to the at least two struts.

7. The collapsible structure as set forth in claim 4, wherein a distance between a connection point of the connection points and the first hub for any one the at least two struts is greater than a length of a respective one of the at least two locking struts.

8. The collapsible structure as set forth in claim 7, wherein the distance between the connection point and the first hub for the one of the at least two struts multiplied by a cosine of an angle defined by a plane in which the connection points of all of the at least two struts lie and the one of the at least two struts is less than the length of the respective one of the at least two locking struts.

9. The collapsible structure as set forth in claim 4, wherein a distance between a connection point of the connection points and the first hub for any one of the at least two struts multiplied by a cosine of an angle defined by a plane in which the connection points of all of the at least two struts lie and the one of the at least two struts is less than the length of the respective one of the at least two locking struts.

10. The collapsible structure as set forth in claim 4, wherein the at least two struts comprises at least three struts.

11. The collapsible structure as set forth in claim 4, wherein the at least two struts comprises at least four struts.

12. A collapsible structure with a self-locking mechanism, comprising:

a first hub;

at least two struts pivotably connected at first ends thereof to the first hub and movable relative to each another between a folded position and an expanded position;

a tension member adapted to limit pivotable movement of the at least two struts such that, when in the expanded position, the at least two struts define an angle of less than 180°;

a locking hub having no rigid connection to the first hub;

at least two locking struts pivotably connected at first distal ends thereof to the locking hub and, at second distal ends thereof, to connection points on respective ones of the at least two struts, at least two second struts pivotably connected at first ends thereof to respective ones of the at least two struts, at least two second hubs, second ends of the at least two second struts being pivotably connected to respective ones of the at least two second hubs, at least two third struts, first ends of the at least two third struts being pivotably connected to respective ones of the at least two second hubs, at least two third hubs, second ends of the at least two first struts being pivotably connected to respective ones of the at least two third hubs, at least two fourth struts, first ends of the at least two fourth struts being pivotably connected to respective ones of the at least two third hubs and being pivotably connected to respective ones of the at least two third struts.

13. The collapsible structure as set forth in claim 12, wherein the at least two first struts and the at least two fourth struts are each adapted to pivot through an angle greater than 90° when the at least two first struts and the at least two fourth struts pivot relative to respective ones of the at least two third hubs between a folded position and a locked position.

14. The collapsible structure as set forth in claim 12, wherein the at least two second struts are pivotably connected to respective ones of the at least two struts at the connection points on respective ones of the at least two struts.

15. The collapsible structure as set forth in claim 12, wherein the at least two second struts are pivotably connected to respective ones of the at least two struts at points between the connection points and the second ends of respective ones of the at least two struts.

16. The collapsible structure as set forth in claim 12, comprising four struts, including the at least two struts, pivotably connected at first ends thereof to the first hub and spaced relative to one another about the first hub at 90° and movable relative to each another between a folded position and an expanded position;

the tension member being adapted to limit pivotable movement of the four struts such that, when in the expanded position, the four struts define an angle of less than 180°;

four locking struts, including the at least two locking struts, pivotably connected at first ends thereof to the locking hub and, at seconds ends thereof, to connection points on respective ones of the four struts;

four second struts, including the at least two second struts, pivotably connected at first ends thereof to respective ones of the four struts, four second hubs, including the at least two second hubs, second ends of the four second struts being pivotably connected to respective ones of the four second hubs, four third hubs, including the at least two third hubs, second ends of the four struts being pivotably connected to respective ones of the four third hubs.

17. The collapsible structure as set forth in claim 12, comprising at least two fourth hubs, second ends of the at least two fourth struts being pivotably connected to respective ones of the at least two fourth hubs, at least two fifth struts, first ends of the at least two fifth struts being pivotably connected to respective ones of the at least two fourth hubs, at least two fifth hubs, second ends of the at least two third struts being pivotably connected to respective ones of the at least two fifth hubs, at least two sixth struts, first ends of the at least two sixth struts being pivotably connected to respective ones of the at least two fifth hubs, the at least two sixth struts being pivotably connected to respective ones of the at least two fifth struts.

18. The collapsible structure as set forth in claim 17, wherein the at least two third struts and the at least two sixth struts are each adapted to pivot through an angle greater than 90° when the at least two third struts and the at least two sixth struts pivot relative to respective ones of the at least two fifth hubs between a folded position and a locked position.

19. The collapsible structure as set forth in claim 18, further comprising a stop for preventing the locking hub from moving beyond a locking position in the expanded position.

20. A collapsible structure with a self-locking mechanism, comprising:

a first hub;

at least two struts pivotably connected at first ends thereof to the first hub and movable relative to each another between a folded position and an expanded position;

a tension member adapted to limit pivotable movement of the at least two struts such that, when in the expanded position, the at least two struts define an angle of less than 180°;

a locking hub; and at least two locking struts pivotably connected at first ends thereof to the locking hub and, at seconds ends thereof, to connection points on respective ones of the at least two struts;

at least two second struts pivotably connected at first ends thereof to respective ones of the at least two struts, at least two second hubs, second ends of the at least two second struts being pivotably connected to respective ones of the at least two second hubs, at least two third struts, first ends of the at least two third struts being pivotably connected to respective ones of the at least two second hubs, at least two third hubs, second ends of the at least two first struts being pivotably connected to respective ones of the at least two third hubs, at least two fourth struts, first ends of the at least two fourth struts being pivotably connected to respective ones of the at least two third hubs and being pivotably connected to respective ones of the at least two third struts;

four struts, including the at least two struts, pivotably connected at first ends thereof to the first hub and spaced relative to one another about the first hub at 90° and movable relative to each another between a folded position and an expanded position;

the tension member being adapted to limit pivotable movement of the four struts such that, when in the expanded position, the four struts define an angle of less than 180°;

four locking struts, including the at least two locking struts, pivotably connected at first ends thereof to the locking hub and, at seconds ends thereof, to connection points on respective ones of the four struts;

four second struts, including the at least two second struts, pivotably connected at first ends thereof to respective ones of the four struts, four second hubs, including the at least two second hubs, second ends of the four second struts being pivotably connected to respective ones of the four second hubs, four third hubs, including the at least two third hubs, second ends of the four struts being pivotably connected to respective ones of the four third hubs;

four extension hubs, eight extension struts, four pairs of the eight extension struts being pivotably connected at first ends thereof to respective ones of the four second hubs at right angles to the second struts and being pivotably connected at second ends thereof to respective ones of the four extension hubs, and eight extension arms, four pairs of the eight extension arms being pivotably connected at first ends thereof to respective ones of the four third hubs at right angles to the first struts and each of the eight extension arms being pivotably connected at second ends thereof to respective ones of the eight extension struts.

21. The collapsible structure as set forth in claim 20, comprising four fourth hubs, including the at least two fourth hubs, second ends of the four fourth struts being pivotably connected to respective ones of the four fourth hubs, four fifth struts, first ends of the four fifth struts being pivotably connected to respective ones of the four fourth hubs, four fifth hubs, second ends of the four third struts being pivotably connected to respective ones of the four fifth hubs, four sixth struts, first ends of the four sixth struts being pivotably connected to respective ones of the four fifth hubs, the four sixth struts being pivotably connected to respective ones of the four fifth struts.

22. The collapsible structure as set forth in claim 21, wherein the four third struts and the four sixth struts are each adapted to pivot through an angle greater than 90° when the four third struts and the four sixth struts pivot relative to respective ones of the four fifth hubs between a folded position and a locked position.

* * * * *